United States Patent [19]

Barlow et al.

[11] 4,367,875

[45] Jan. 11, 1983

[54] BOXING GAME

[75] Inventors: Gordon A. Barlow, Glenview; John R. Newcomer, Des Plaines; John R. Krutsch, Glenview; Fred Bezark, Northbrook, all of Ill.

[73] Assignee: Gordon Barlow Design, Skokie, Ill.

[21] Appl. No.: 346,638

[22] Filed: Feb. 8, 1982

[51] Int. Cl.[3] ..... A63F 9/14; A63H 13/06

[52] U.S. Cl. ..... 273/85 F; 46/88; 46/142; 273/384

[58] Field of Search ..... 273/85 F, 85 R, 85 E, 273/384, 383; 46/142, 143, 148, 87, 88, 90

[56] References Cited

U.S. PATENT DOCUMENTS

| | | | |
|---|---|---|---|
| 2,435,141 | 1/1948 | Koci | 273/85 F X |
| 2,635,386 | 4/1953 | Guischard | 46/88 |
| 3,229,418 | 1/1966 | Dragich | 46/88 |
| 3,235,259 | 2/1966 | Glass et al. | 273/85 F |
| 3,698,374 | 10/1972 | Casper | 46/88 X |
| 3,848,357 | 11/1974 | Morrison | 46/142 |
| 3,856,304 | 12/1974 | Matsumoto et al. | 273/85 F |
| 4,248,008 | 2/1981 | Pitkanen | 46/88 |
| 4,319,751 | 3/1982 | Kurushima et al. | 46/142 X |

FOREIGN PATENT DOCUMENTS

| | | | |
|---|---|---|---|
| 1062745 | 12/1953 | France | 46/142 |
| 625389 | 9/1961 | Italy | 273/85 F |
| 2040708 | 9/1980 | United Kingdom | 273/85 F |

*Primary Examiner*—Paul E. Shapiro

*Attorney, Agent, or Firm*—Kinzer, Plyer, Dorn & McEachran

[57] ABSTRACT

A boxing type amusement game including a pair of figures of boxers. Each boxer has a torso with a blow actuated trigger. An inflated launchable balloon is mounted as a head on each torso. At least one arm is pivotally mounted on the torso and has a fist for hitting and actuating a trigger of an opposing boxer. The launchable balloon is mounted on the torso under tension and sealed against air leakage. The trigger releases the balloon and launches it when it is struck by the fist of an opposing boxer.

8 Claims, 5 Drawing Figures

BOXING GAME

BACKGROUND AND SUMMARY OF THE INVENTION

This invention is directed to a game which realistically simulates a boxing match using manipulatable toy figures of boxers. It is designed to be played by two players and is small enough to be placed on a table top. Each player has his own boxer mounted on a slidable platform which extends into a small scale replica of a boxing ring. Each player can slide his platform fore and aft and from side to side so that he can manuever his boxer relative to the other boxer in the same way that boxers would actually manuever relative to each other in an actual boxing match. Each player can also deliver punches to his opponent. This is accomplished by a push button on the platform, the actuation of which swings the fist of a fighter at his opponent. Each boxer has a trigger mechanism located in his solar plexis which brings about his demise if forcefully struck by his opponent. As a matter of fact, a boxer will lose his head if solidly struck by his opponent on the trigger mechanism. The boxer loses his head and goes down for the knockout because his head is an inflated balloon held in place and sealed against air leakage by the trigger mechanism. When the trigger mechanism is driven rearwardly by a blow to the boxer's solar plexis, the balloon is launched indicating a knockout. The launching is due to the inherent flexibility of the inflated balloon and also the jet effect obtained by the escape of air from the balloon when it is released. Each boxer is arranged so that an inflated balloon can easily be installed as the head of the boxer and clamped in an air closing position.

Other objects and advantages of the invention may be found in the following specification, claims and drawings.

BRIEF DESCRIPTION OF THE DRAWINGS

The invention is illustrated more or less diagrammatically in the following drawings wherein.

DESCRIPTION OF THE PREFERRED EMBODIMENT

Figure 1:
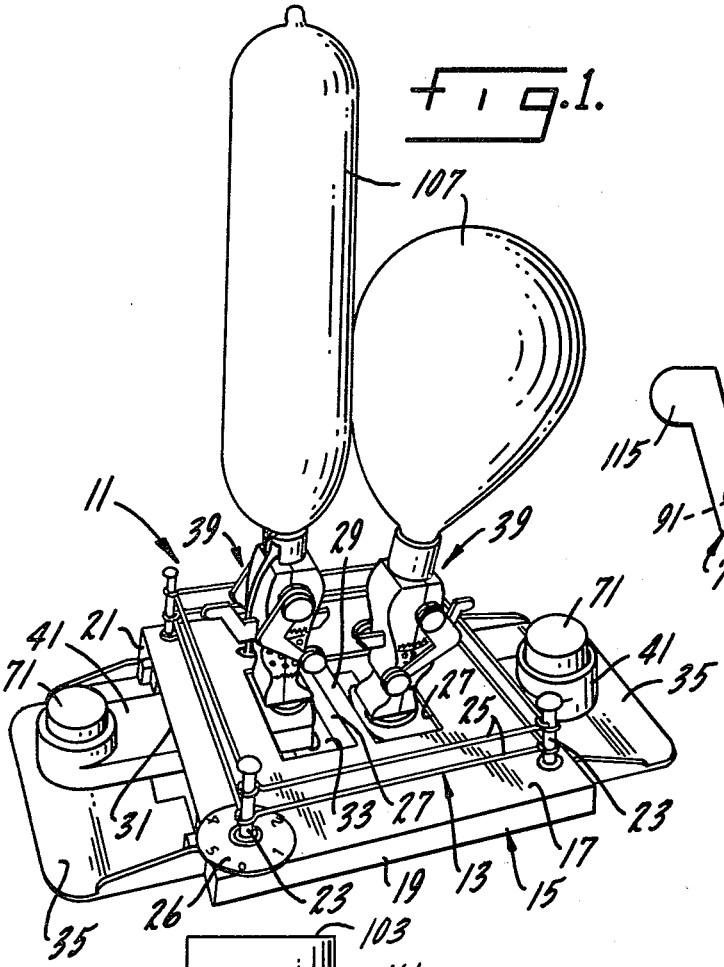
FIG. 1 is a perspective view of the boxing game of this invention.
Figure 2:
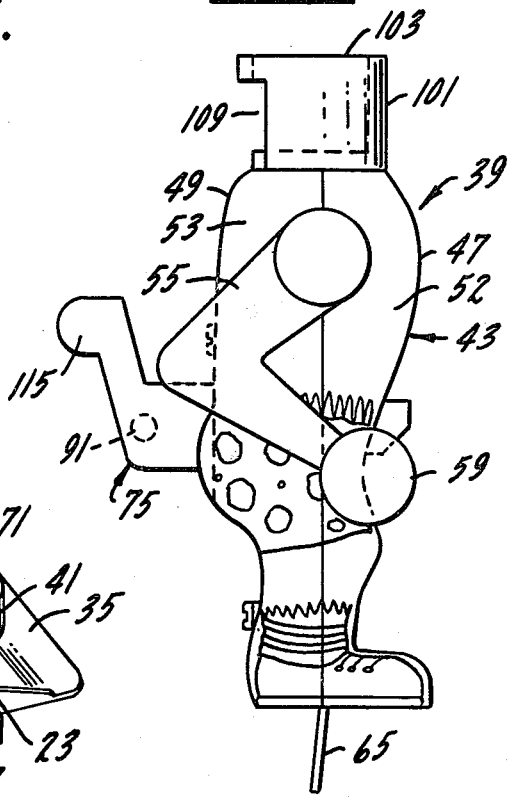
FIG. 2 is a side elevational view on an enlarged scale of one of the boxers with parts omitted for clarity of illustration.

A game 11 embodying the novel features of this invention is shown in the drawings. The game includes a boxing ring 13 having a plastic base 15 in the shape of an open bottom rectangular box having a top deck or "canvas" surface 17, sidewalls 19 and end walls 21. Posts 23 are mounted on the deck 17 at the corners thereof and pieces of plastic simulating ropes 25 extend between the posts to give the appearance of a boxing ring. A rotatable dial 26 with numbers is positioned at the base of two diagonally located posts only one of which is shown to designate the knockouts of boxer in a boxing match. A pair of wells 27 are provided in the deck 17 and are separated by a divider 29. Passages 31 extend through the end walls 21 and lead into each of the well sections 27. A footing 33 is provided at the bottom of each well section 27. Aprons 35 extend outwardly from the end walls 21 of the base.

The game 11 is provided with two miniature figures 39 each of which are replicas of boxers. Each figure stands upright at an end of a separate elongated slidable platform 41. The platforms are installed in the base 15 so that each extends through a passage 31 located in an end wall 21 to position its boxer 39 inside a well section 27. The opposite end of each platform rests on the footing 33 at the bottom of its well section and on the apron 35 which extends outwardly from the end wall 21 of the base. The slidable platforms 41 can be moved reciprocally and from side to side relative to the ring. This flexibility permits each boxer 39 to be moved by its player relative to the other boxer sideways and back and forth in the ring.

Figure 3:
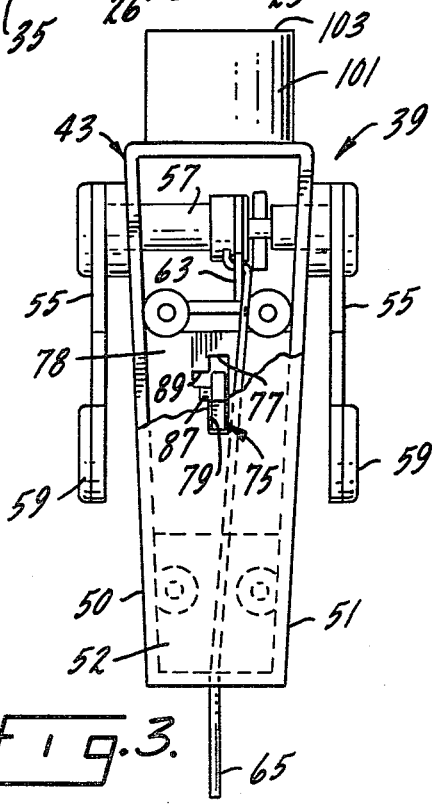
FIG. 3 is a front elevational view of the boxer of FIG. 2 with some parts broken away.
Figure 4:
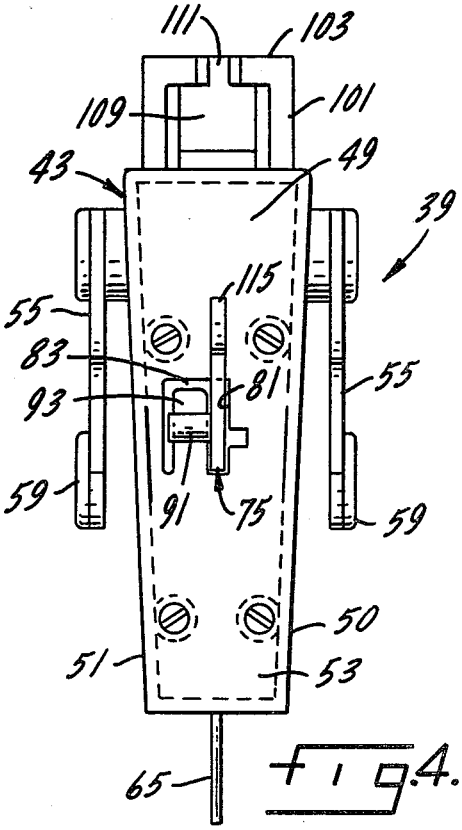
FIG. 4 is a rear elevational view of the boxer of FIG. 2.
Figure 5:
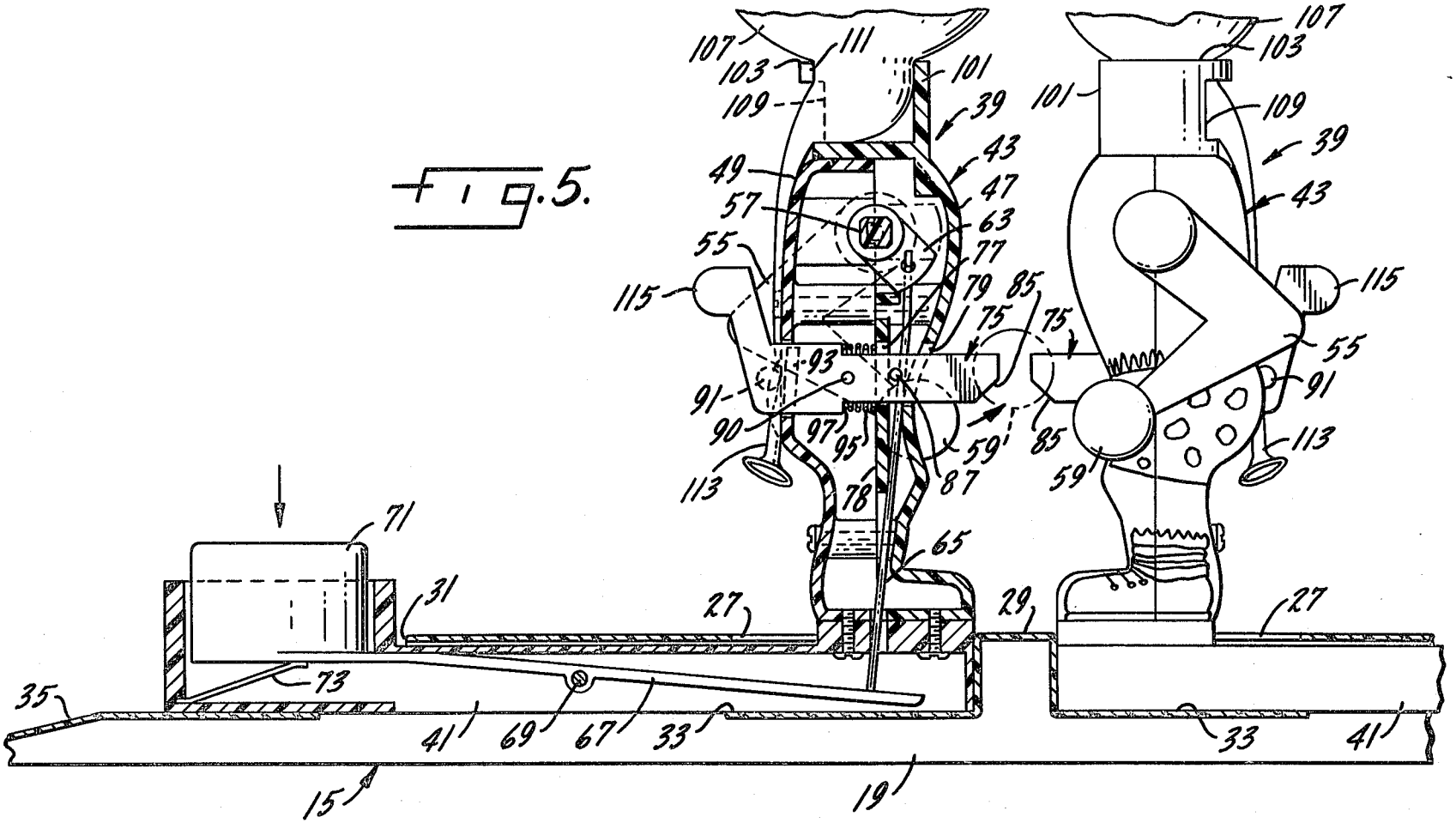
FIG. 5 is a partial view on an enlarged scale of the game of FIG. 1 with some parts omitted, some parts shown in cross-section, some parts shown in dashed lines, and some parts broken away for clarity of illustration with the trigger actuating position of the fist of one boxer shown in phantom line.

Each boxer 39 is preferably formed of plastic and has a generally hollow torso 43 shown in detail in FIGS. 3, 4 and 5 of the drawings. Each torso includes a front or chest wall 47, a back wall 49, a right side 50 and a left side 51. The torso is divided lengthwise into front and rear portions 52 and 53 respectively which are fastened together by screws or in any other conventional manner. Each boxer has arms 55 attached to a shaft 57 which is pivotally mounted relative to the torso. A fist 59 is formed at the end of each arm.

The shaft 57 has a crank arm 63 affixed thereto inside the torso 43. A connecting rod 65 is attached to the free end of the crank arm and this rod extends through the torso into the slidable platform 41 where it rests on one end of a rocker beam 67 which is pivotally mounted adjacent its center at axis 69. The opposite end of the rocker beam is connected to a push button 71 located at the other end of the slidable platform 41. A spring 73 urges the push button upward. Depression of the push button 71 by a player in the direction of the arrow in FIG. 5 causes the arms 55 of a boxer to deliver uppercut blows which can be directed at the other miniature boxer 39 in the ring 13.

Each boxer is equipped with a trigger mechanism 75 mounted in its torso 43. The trigger mechanism extends through an irregular shaped slot 77 formed in a partition 78 located inwardly of the chest wall, through a slot 79 in the chest 47, through an aligned leg 81 of a U-shaped slot 83 formed in the back wall 49 of the torso. The trigger mechanism has a cam surface 85 on its end located in front of the chest wall 47 to convert a blow from a fist 59 of a miniature boxer 39 into an upward as well as a rearward movement of the trigger mechanism 75.

Rearward and upward movement of the trigger mechanism 75 from its "cocked" position shown in FIG. 5 causes a lug 87 projecting from a side of the trigger mechanism to move through a notch 89 formed in the inner partition 78 of the torso and connected with the slot 77. Release of the lug from engagement with the inner partition 78 of the torso permits rearward movement of the trigger mechanism 75. A second lug 90 projects from a side of the trigger mechanism and is located between the inner partition 78 and the back wall 49 of the torso limits rearward movement of the trigger mechanism by engaging the inside of the back wall 49 of the torso.

The rear end of the trigger mechanism 75 which extends through the leg 81 of the slot 83 in the back wall 49 of the torso also is equipped with a transversely extending lug 91 which engages a cantilevered flap 93 formed in the back of the torso by the U-shaped slot 83. Thus, actuation of the "cocked" trigger mechanism 75 releases the lug 91 from clamping engagement with the cantilevered flap 93. A coil spring 95 is provided for the trigger mechanism 75 so that when it is in its "cocked" position with the lug 87 engaging the inner partition 78 of the torso, the spring will be in its compressed position engaging a shoulder 97 of the trigger mechanism and the inner partition 78 of the torso. The spring 95 provides a sharp, clean release of the trigger mechanism when it is actuated.

A tubular neck 101 is mounted on top of the torso 43. The top edge 103 of the tubular neck provides a seat for an inflated balloon 107 which functions as the head of each boxer. A radially opening passage 109 is formed in the back of the neck. This passage is narrowed at 111 near the top edge 103 of the neck so as not to reduce unduly the area of the top surface 103 supporting the inflated balloon 107. The uninflated filling tube 113 of the inflated balloon 107 is stretched through the passage 111 as the balloon is supported on the top edge 103 of the neck. The uninflated filling tube 113 is positioned against the flap 93 in the back wall 49 of the torso where it is clamped by the lug 91 to prevent the escape of air from the balloon and the release of the balloon from the neck 101 of the boxer.

When a blow is struck by a fist 59 of one boxer 39 to the cam surface 85 at the end of the trigger mechanism 75 of the other boxer, as shown by the phantom line position of the fist 59 of the boxer 39 on the left of FIG. 5, the trigger mechanism is moved rearwardly and upwardly. This movement releases lug 87 from engagement with the inner partition 78 and allows the lug to move through the notch 89. The compression spring 95 then moves the trigger mechanism rapidly in a rearward direction releasing the lug 91 from clamping engagement with the filling tube 113 of the inflated balloon 107. When the filling tube of the balloon is released from its clamped position, the tension of the inflated balloon acting against the top edge 103 of the tubular neck 101 of the boxer and the reaction due to the escape of air from the balloon launch the balloon from the boxer. Therefore, a well directed blow from one boxer to the other will be immediately indicated by the boxer who is struck losing his head.

When one player scores a "knockout" of his opponent's boxer 39, he moves his dial 26 to increase his score. His opponent replaces his balloon 107 by inflating it and remounting it on the tubular neck 101 of his boxer. The balloon clamping and sealing mechanism of this invention facilitates the reattachment of a balloon. The player needs only support the inflated balloon on the top edge 103 of the tubular neck 101, stretch the uninflated filling tube 113 of the balloon through the narrowed passage 111 and position the uninflated filling tube over the flap 93 in the back wall 49 of the torso. The player then pushes against handle 115 on the trigger mechanism 75 to move the trigger mechanism forward. Forward movement of the trigger mechanism moves lug 91 to clamp the uninflated balloon filling tube 113 against the flap 93 in the back wall 49 of the torso thereby holding the inflated balloon on the boxer's head under tension and sealing the balloon against the leakage of air. Upon forward movement of the trigger mechanism, the lug 87 moves through the notch 89 in the inner partition 78 and into engagement with the front face of the inner partition locking the trigger mechanism in its "cocked" position. Smooth movement of the lug 87 through the notch 89 is facilitated by a cam surface (not shown) on the notch 89. Because of the upward extension of the trigger mechanism handle 115, the trigger pivots about lug 91 forcing the lug 87 downwardly and holding it in engagement with the inner partition 78.

We claim:

1. A boxing type amusement game including a pair of figures of boxers, each figure of a boxer including:

a torso having a blow actuated trigger, means to releasably mount a head on the torso in the form of an inflated launchable balloon, at least one arm pivotally mounted on the torso and having a fist means for hitting and actuating a trigger of an opposing boxer, and means to releasably hold the launchable balloon mounted on the torso under tension and sealed against air leakage, said balloon release and sealing means being operably connected to the trigger to release the balloon from tension, unseal the air and launch the balloon upon actuation of the trigger as the result of a blow from an opposing boxer.

2. The game of claim 1 having means to selectively move the arm about its pivotal mounting to drive its fist means into actuating contact with the trigger of the opposite boxer figure.

3. The game of claim 2 in which the means to selectively move the arm about its pivotal mounting includes a shaft forming the pivotal mounting for the arm, a crank arm affixed to the shaft, a connecting rod attached to the outer end of the crank arm and extending through the torso of the boxer to one end of a rocker beam, the opposite end of the rocker beam being connected to a push button.

4. The game of claim 3 in which each boxer figure is mounted on one end of a separate slidable platform, the push button is located at the opposite end of each sliding platform and the rocker beam is located in the platform and extends between the push button and the connecting rod.

5. The game of claim 2 including two boxer figures, each mounted on a separate slidable platform, a boxing ring having a base, a well formed in the base, the slidable platforms extending into the well through opening in the sides of the base, the boxer figures being mounted on the ends of the platforms extending into the well and the push buttons for actuating the boxers' arms being located on the portions of the platforms located outside of the ring.

6. The game of claim 1 in which the blow actuated trigger is located on the chest portion of each boxer figure torso.

7. The game of claim 1 in which the means to mount an inflated launchable balloon on the torso includes a tubular neck mounted on the top of the torso with the tubular neck having a top surface forming a seat for the inflated balloon, a slit formed in the back of the tubular neck and extending down the neck to permit inserting the uninflated fill portion of the inflated balloon into the neck so that the inflated portion of the balloon is supported on the top surface seat and the remainder of the uninflated fill portion of the balloon to be positioned against the back of the torso.

8. The game of claim 1 in which the means to releasably hold the launchable balloon in tension and sealed against air leakage includes a surface on the back of the torso against which the uninflated fill portion of the balloon is stretched and a clamping member which forces this portion of the balloon against the torso surface.

* * * * *